US008212485B2

(12) United States Patent
Elek et al.

(10) Patent No.: US 8,212,485 B2
(45) Date of Patent: Jul. 3, 2012

(54) DIMMING BRIDGE MODULE

(75) Inventors: Joseph G. Elek, North Ridgeville, OH (US); Edward Thomas, Streetsboro, OH (US); Tony Aboumrad, Parma, OH (US)

(73) Assignee: General Electric Company, Schenectady, NY (US)

( * ) Notice: Subject to any disclaimer, the term of this patent is extended or adjusted under 35 U.S.C. 154(b) by 342 days.

(21) Appl. No.: 12/634,764

(22) Filed: Dec. 10, 2009

(65) Prior Publication Data

US 2011/0140611 A1 Jun. 16, 2011

(51) Int. Cl.
*H05B 37/04* (2006.01)

(52) U.S. Cl. ..... 315/130; 315/291; 315/294; 315/297; 315/312; 700/286; 700/295

(58) Field of Classification Search ..... 315/130, 315/291, 294, 297, 312; 700/275, 276, 286, 700/295

See application file for complete search history.

(56) References Cited

U.S. PATENT DOCUMENTS

2003/0036807 A1* 2/2003 Fosler ..... 700/3
2003/0222603 A1* 12/2003 Mogilner et al. ..... 315/294
2004/0122930 A1* 6/2004 Pasternak ..... 709/223
2004/0201448 A1 10/2004 Wang
2005/0179404 A1* 8/2005 Veskovic et al. ..... 315/291
2006/0044152 A1 3/2006 Wang
2006/0125426 A1* 6/2006 Veskovic et al. ..... 315/312
2006/0201448 A1 9/2006 Keil
2006/0215345 A1 9/2006 Huizenga
2008/0192767 A1 8/2008 Howe et al.
2009/0273296 A1* 11/2009 Veskovic et al. ..... 315/246

OTHER PUBLICATIONS

PCT Search Report issued in connection with corresponding WO Patent Application No. US2010/054928 filed on Nov. 1, 2011.
WO Invitation to Pay Addition Fees issued in connection with corresponding WO Patent Application No. US10/54928 filed on Nov. 1, 2010.
PCT/US2010/054928 International Search and Written Opinion, date of mailing Nov. 7, 2011.

* cited by examiner

*Primary Examiner* — Douglas W Owens
*Assistant Examiner* — Thai Pham
(74) *Attorney, Agent, or Firm* — Fay Sharpe LLP

(57) ABSTRACT

A lighting control system is coupled to one or more ballast/drivers operating one or more light sources. A low power control module receives analog, digital and/or DALI signals from one or more sources, processes the signals to provide an appropriate lighting response and outputs one or more commands related to light output of the one or more ballast/drivers operating one or more light sources. A gateway component receives wireless signals from the low power control module to relay to one or more control components. The control components provide instruction to modify the light output of the one or more ballast/drivers operating one or more light sources based at least in part upon the one or more commands received from the low power control module and/or the gateway component.

19 Claims, 5 Drawing Sheets

DIMMING BRIDGE MODULE

BACKGROUND

The present application is directed to interface circuits for lighting systems. It finds particular application in conjunction with low power control modules that receive hardwire signals from sensors, which are relayed wirelessly to high level controllers within a system architecture to facilitate control within lighting systems, and will be described with particular reference thereto. It is to be appreciated, however, that the present exemplary embodiments are also amenable to other like applications.

Lighting control systems are frequently used to provide illumination to industrial buildings, commercial structures and other large spaces. Conventional lighting control systems include a user interface, a controller, a power supply, light sources (e.g., incandescent, florescent, etc.) and cable to couple the light sources to the controller and the power supply. The user interface can be employed to allow a user to turn on, turn off and dim light sources within the system by interfacing to the power supply and/or a ballast/driver associated with power delivery to the light sources. A user can program lighting levels based upon one or more conditions such as a time of day, room occupancy, presence/absence of daylight, an event, an alarm and/or any combination of these conditions.

Fluorescent light sources are a popular choice to use within lighting control systems as they have many advantages over incandescent light sources. For example, fluorescent light sources can convert ten times more input power to visible light than incandescent light sources. In addition, a fluorescent light source lasts ten to twenty times as long as an equivalent incandescent light source when operated several hours at a time. Compared with an incandescent light source, a fluorescent tube is a more diffuse and physically larger light source. Thus, light can be more evenly distributed without point source of glare such as seen from an undiffused incandescent filament. Moreover, two-thirds to three-quarters less heat is given off by fluorescent light sources compared to an equivalent installation of incandescent light sources. This greatly reduces the size, cost, and energy consumption of lighting equipment.

Lighting systems can be controlled by analog and/or digital control protocols communicated via a hardwire network. In one example, an analog hardwire control system varies between 0-10VDC to provide simple control to the devices within the system. The controlled lighting can be scaled such that at 10V, light sources are around 100 percent of potential output, and at 0 volts are at around 0 percent output (off). With fluorescent light sources, this analog control is provided to the ballast/driver to adjust the light output as desired. Dimming devices can also be designed to respond in various patterns to intermediate voltages, wherein output curves are linear for voltage output, actual light output, power output and/or perceived light output.

Hardwire control systems can require significant expense related to installation and maintenance within a lighting system. In one example, control of ballast/drivers and associated lighting within a building can require several thousand feet of cabling, mounting brackets, apertures, etc. Moreover, use of a physical connection to communicate with each ballast/driver and/or light source brings inherent problems associated with material breakdown and/or failure. In one example, conventional control system components, such as ballast/drivers, require high voltage (e.g., 277 VAC) to operate. These high voltage lines often require housing in a conduit and/or other safety measures, which can limit the location of components coupled thereto. Accordingly, increased costs can be incurred for additional materials, rerouting power and/or control lines, redesign of layout, etc.

Thus, systems and methods are needed to overcome the above-referenced problems with hardwire networks used with lighting control systems and others.

BRIEF DESCRIPTION

According to an aspect, a lighting control system is coupled to one or more ballast/drivers operating one or more light sources. A low power control module receives analog, digital and/or DALI signals from one or more sources, processes the signals to provide an appropriate lighting response and outputs one or more commands related to light output of the one or more ballast/drivers operating one or more light sources. A gateway component receives wireless signals from the low power control module to relay to one or more control components. The control components provide instruction to modify the light output of the one or more ballast/drivers operating one or more light sources based at least in part upon the one or more commands received from the low power control module and/or the gateway component.

According to another aspect, a lighting control system includes one or more zones, each zone is related to a predetermined area and includes a plurality of ballast/drivers, light sources and one or more sensors. A low power control module is associated with each of the one or more zones, each low power control module receive signals from the one or more sensors related to the associated zone, processes the signals to provide an appropriate lighting response for the associated zone and outputs one or more commands related to light output of the one or more light sources within the associated zone. One or more ballast/drivers, associated with each of the light sources within one or more zones, deliver power to the plurality of light sources based at least in part upon the one or more commands received from the low power control module.

According to yet another aspect, a method is employed to provide control to a lighting system via a low power control module. The control module is secured to a predetermined support and a lower power input is received, outside a conduit, to deliver power to the control module. One or more of a digital, an analog and/or a DALI lighting sensor signals is received via the control module. A lower power relay driver signal is output to toggle line power to a ballast/driver based at least in part upon the lighting sensor signal. If line power is delivered to the ballast/driver, a control signal is output to the ballast/driver based at least in part upon the lighting sensor signals to modify lighting sources coupled to the ballast/driver.

DETAILED DESCRIPTION

Figure 1:
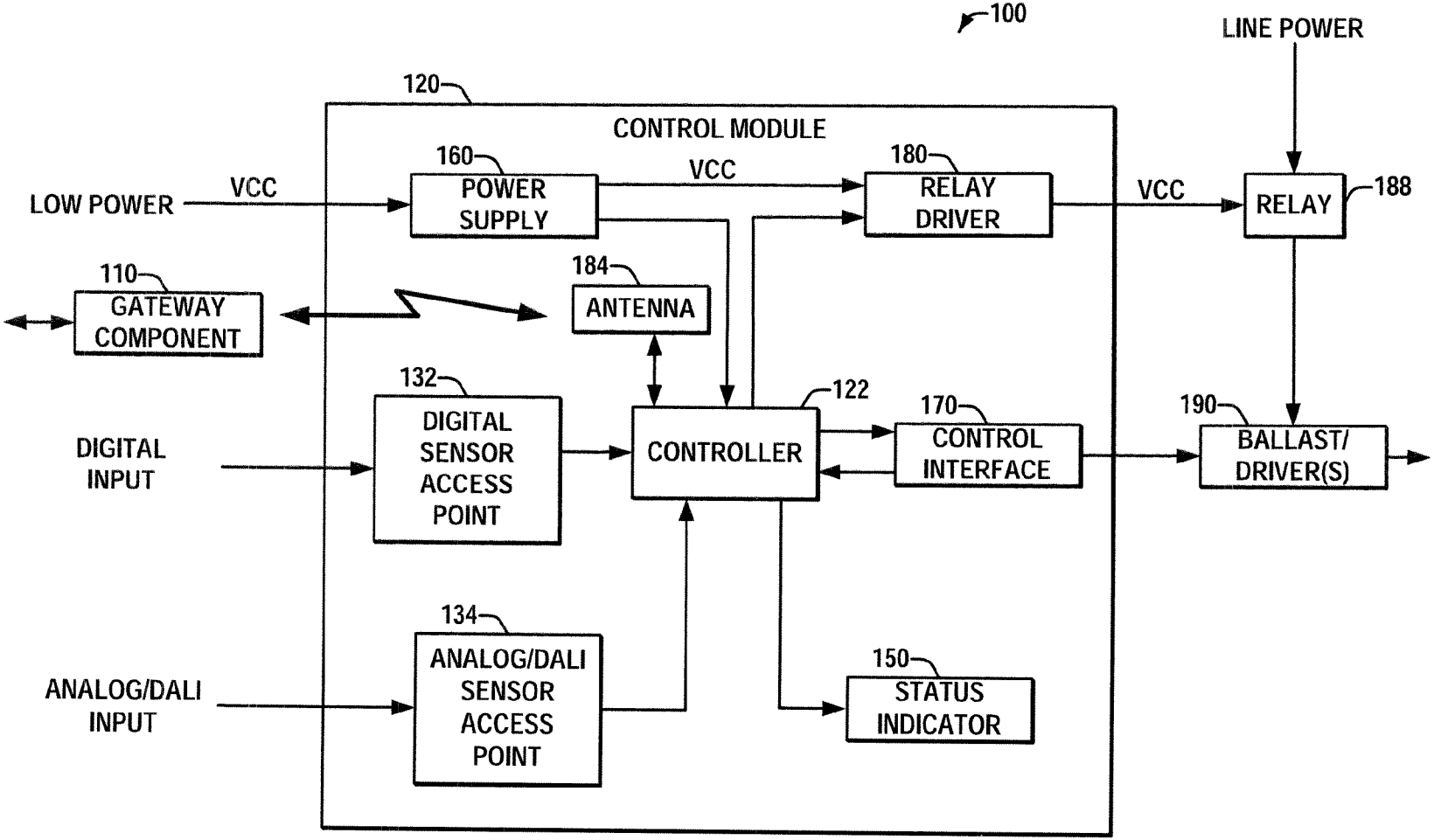
FIG. 1 illustrates a low power control module that receives input signals, which are transmitted wirelessly within a lighting control architecture and employed to provide dimming control to ballast/driver(s) to coupled to one or more light sources.

FIG. 1 illustrates a lighting control system 100 that includes a gateway component 110, a low power control module 120 and a ballast/driver(s) 190. The system 100 can be a mesh network wherein connections are dynamically updated and optimized to ensure operability and communication with the system 100 in substantially any condition. The low power control module 120 can receive digital, analog and/or DALI signals from one or more sources within the system 100 and provide local control to light sources and/or broadcast this information to one or more upstream control components to affect system-wide control. The signals received by the gateway component 110 can be sent from sensors, controllers, timers or other devices that impact light output within the control system 100. Alternatively or in addition, the signals from these devices can be received indirectly via one or more disparate gateway components. In this manner, signals transmitted from any device within a control system can be routed in a plurality of paths to guarantee they are received as desired.

Sensors, located proximate to one or more light sources, can be the source of signals received by the low power control module 120. In one example, the sensors are photocells that activate a light source when a darkness threshold is reached in a room. In another example, the sensors are motion detectors, which quantify motion and to alert the presence of a moving object within a field of view. An electronic motion detector can contain a motion sensor that transforms the detection of motion to an electric signal. This can be achieved by measuring optical or acoustical changes in the field of view. Occupancy and vacancy sensors are particular types of motion detectors that are generally integrated with a timing device. Occupancy sensor detect movement within a predefined space to trigger an output (e.g., to turn on a light source). In contrast, vacancy sensors detect lack of movement for a predetermined period of time in order to trigger an output (e.g., to extinguish light within an associated space). It is to be appreciated that the functionality of both sensor types can be embodied in a single unit as an occupancy/vacancy sensor.

In one embodiment, the occupancy/vacancy sensor utilizes a timer in combination with one or more of a pyroelectric infrared sensor (PIR), an ultrasonic sensor and a microwave sensor. A PIR can identify heat difference within the detection space; an ultrasonic sensor sends out pulses and measures reflection off a moving object; and a microwave sensor sends out microwave pulses and measures the reflection off a moving object. Occupancy/vacancy sensors can utilize two or more of these technologies to provide optimum performance.

Information can be received by the low power control module 120 from substantially any "off the shelf" device via the digital sensor access point 132 and an analog/DALI access point 134. Each of the access points 132 and 134 can process and scale received signals as appropriate for consumption via the controller 122. Digital information is received via a digital sensor access point 132 and analog and/or DALI signals are received via an analog/DALI sensor access point 134 within the low power control module 120. Utilizing the access points 132 and 134 allows the low power control module 120 to receive and process information from a wide array of devices.

In one example, a digital signal is received from an occupancy/vacancy sensor that indicates an occupant is present within a particular zone. The digital sensor access point 132 can process the digital signal and output as a bit to the controller 122. In one scenario, if the bit is a predetermined value (e.g., ON), the low power control module 120 can communicate with the ballast/driver(s) 190 to turn on one or more light sources within the subject zone.

In another example, an analog signal is received from a sensor that measures and outputs a darkness level within a zone. The analog/DALI sensor access point 134 can scale the analog value received to a range that is compatible with the controller 122. In turn, the controller 122 can compare the received analog signal to a predetermined threshold. In one embodiment, if the threshold is exceeded, instruction can be sent to the ballast/driver(s) 190 to illuminate one or more light sources in an appropriate location within the zone.

The controller 122 receives information from the digital sensor access point 132 and/or the analog/DALI sensor access point 134. The controller 122 can include a memory and a processor to store and execute one or more programs to process the information received. Processing can include identifying a data type and/or a protocol of the signal, extracting relevant information and comparing the extracted information to one or more thresholds. The comparison can be made using a rule set that provides different threshold levels and/or messaging that is relevant to the signal source, location and other factors. It is to be appreciated that processing can include any number of protocols, standards and iterations commensurate with the embodiments discussed herein.

Once processing is complete, the controller 122 can output signals to indicate an operational status of the low power control module 122, dim or brighten light output of light sources coupled thereto, disconnect power from one or more light sources, and/or communicate with upstream control components. For instance, a control interface 170 can provide an analog signal, a digital signal, a pulse-width modulated (PWM) signal and/or a DALI signal to provide dimming control, whereas a relay driver 180 can facilitate connection of power to the ballast/driver(s) 190.

The controller 122 can output a signal to a status indicator 150 that provides a visual notification to maintenance personnel or other users of the current state of the low power control module 120. The status indicator 150 can be an LED with at least three color states, each of which are indicative of a disparate condition of the low power control module 120. A first state can be a green color output which indicates a satisfactory condition with both the controller 122 and communication received. A second state can be a yellow color output that indicates no communication has been received by the low power control module 120 for longer than a predetermined timeframe. This can be due to network failure, media failure or other causes that prevent communication. A third state can be a red color and indicate that the low power control module 120 has failed as opposed to the communication network. In this manner, maintenance personnel can focus on an appropriate location within the control architecture to troubleshoot and resolve issues as they occur.

The controller 122 can output analog, digital, PWM and/or DALI signals to the control interface 170 to dim and brighten light sources coupled to the ballast/driver(s) 190. In one example, the control interface 170 communicates with the ballast/driver(s) 190 and the controller 122 as set forth in U.S.

patent application Ser. No. 12/259,492, incorporated herein by reference. The ballast/driver(s) 190 can have a Digital Addressable Lighting Interface (DALI) interface, in one embodiment, wherein each light source is individually activated based on a particular condition. The DALI protocol uses a bi-directional data exchange to allow configuration, control and communication with each independently addressable light source coupled to the ballast/driver(s) 190. In one example, a timer sends a signal to the gateway component 110 that a predetermined time has been reached (e.g., 7 AM). In response, the low power control module 120 can illuminate light sources within a particular zone (e.g., a floor, a room, a floor section, etc.) via the ballast/driver(s) 190.

The ballast/driver(s) 190 are representative of any number of ballast/drivers to accommodate a wide range of control architectures and can be coupled to any number of light sources. The ballast/driver(s) 190 are can be coupled to substantially any light source including a gas-discharge lamp, a high-intensity discharge lamp, an incandescent lamp, a halogen lamp and/or a light emitting diode (LED). In one example, the gas-discharge lamp is incapable of effectively regulating current use and presents a negative resistance to a power supply wherein the amount of current drawn is increased until the light source is destroyed or causes the power supply to fail. To prevent this, the ballast/driver(s) 190 provide a positive resistance or reactance to limit the ultimate current to an appropriate level. In this way, the ballast/driver (s) 190 provide for the proper operation of the light sources coupled thereto by appearing to be a legitimate, stable resistance in the circuit. For instance, the ballast/driver(s) 190 can be dimming electronic ballast/drivers that can modify light output of light sources connected thereto via pulse-width modulation or other means. In one example, light output of the one or more light sources coupled thereto can be modified via an analog output (e.g., 0-10V) and/or a command in a DALI-compatible format.

In one embodiment, the ballast/driver(s) 190 are electronic ballast/driver, which can operate in an instant start or a rapid start mode. An electronic ballast/driver can employ solid state circuitry to provide the proper starting and operating electrical condition to power the one or more gas-discharge light sources. Electronic ballast/drivers are often based on a switched-mode power supply topology, by first rectifying input power and then chopping it at a high frequency. In one example, the frequency of the input power (e.g., 60 Hz) is changed to 20 kHz or higher, which substantially eliminates stroboscopic effect of flicker associated with gas-discharge lighting. In addition, because more gas remains ionized in the arc stream, the light sources actually operate at a higher efficiency above around 10 kHz.

The ballast/driver(s) 190 can employ several power and cost saving measures such as utilizing a control circuit to apply precise cathode heat until an optimum temperature is reached during light source startup. This reduces the amount of cathode degradation associated with each start and can increase light source life in frequently switched applications. In addition, greater than 90% ballast/driver efficiency can be realized, voltage can be read and adopted automatically, and start time can be shortened (e.g., around 0.7 seconds). The ballast/driver(s) 190 can be one or more of a GE UltraStart 0-10V, a GE UltraStart Bi-Level Switching, a GE UltraMax Bi-Level Switching, a GE UltraMax Load Shed, a GE UltraMax eHID 0-10V or any other commercially available efficient ballast/driver model.

The controller 122 can output a digital signal to a relay driver 180 that interfaces to a relay 188 to connect and disconnect power delivered to the ballast/driver(s) 190. In one example, the relay driver 180 uses a VCC low voltage signal (e.g., 24 VDC) to energize the relay 188 to deliver line power (e.g., 277 VAC) used to power the ballast/driver(s) 190. The relay driver 180 can also de-energize the relay 188 to prevent the delivery of line power to the ballast/driver(s) 190 thereby turning off light sources connected thereto. Utilizing the relay driver 180 allows the low power control module 120 to toggle power delivered to the ballast/driver(s) 190 without requiring line power to flow through the module 120 itself. In this manner, the low power control module 120 can be placed in substantially any location within a lighting control architecture as it is non-reliant on line power for operation or any regulations for conduits, etc. coincident therewith.

The low power control module 120 can send signals to one or more upstream components within the control architecture, via the gateway component 110, to deliver information related to devices coupled locally to the control module 120. In one example, information is sent from the low power control module 120 to the gateway component 110 wirelessly and onward from the gateway component 110 via a hardwire connection to system-wide (e.g., building level) control components. In one approach, a plurality of low power control modules are retrofit into an existing lighting control system wherein sensors are coupled to the control module 120 for local processing and/or remote processing via components at a higher control level.

In one embodiment, wireless signals are broadcast from the low power control module 120 via an antenna 184 at a radio frequency for use with particular wireless network protocols such as Wi-Fi, Bluetooth, and ZigBee. The controller 122 can include a ZigBee Pro stack to facilitate communication via the ZigBee specification as set forth in ZigBee Document 053474r17, ZigBee Specification, Jan. 17, 2008, incorporated in its entirety by reference herein. The gateway component 110 can also communicate using the same or equivalent protocols. In one example, the gateway component 110 is a router that can communicate via both hardwire and wireless protocols.

It is to be appreciated that signals can also be received by the control module 120 from one or more high level control components to impact the light output of one or more light sources connected locally thereto. For instance, information can be utilized to monitor the location of individuals within a building based on the triggering of occupational/vacancy sensors and other devices in communication with the gateway component 110. This information can be compared to other data such as visitor logs, alarms, etc. to determine if personnel are in an appropriate location at a given time. Alternatively or in addition, intelligent decision making can facilitate efficient use of power within a lighting system.

The ZigBee protocol is commonly employed in building control systems as it allows simple communication between components that requires little data processing. Accordingly, ZigBee communication can be employed by components that require low power that can provide a long operation power cycle. As such, the controller can be run via a power supply 160 that receives a low power signal (e.g., 24 VDC) that is converted to an appropriate level for consumption via the controller 122. In one example, the power supply 160 outputs a power signal of 3-4 VDC at around 300 mA to the controller 122. The power supply 160 can also pass through the low power signal (24 VDC) to drive the relay driver 180. This low power signal can be delivered to the relay 188 upon receipt of an appropriate command from the controller 122. In this manner, the low power signal can ultimately control delivery of power to the ballast/driver(s) 190, as discussed above.

Figure 2:
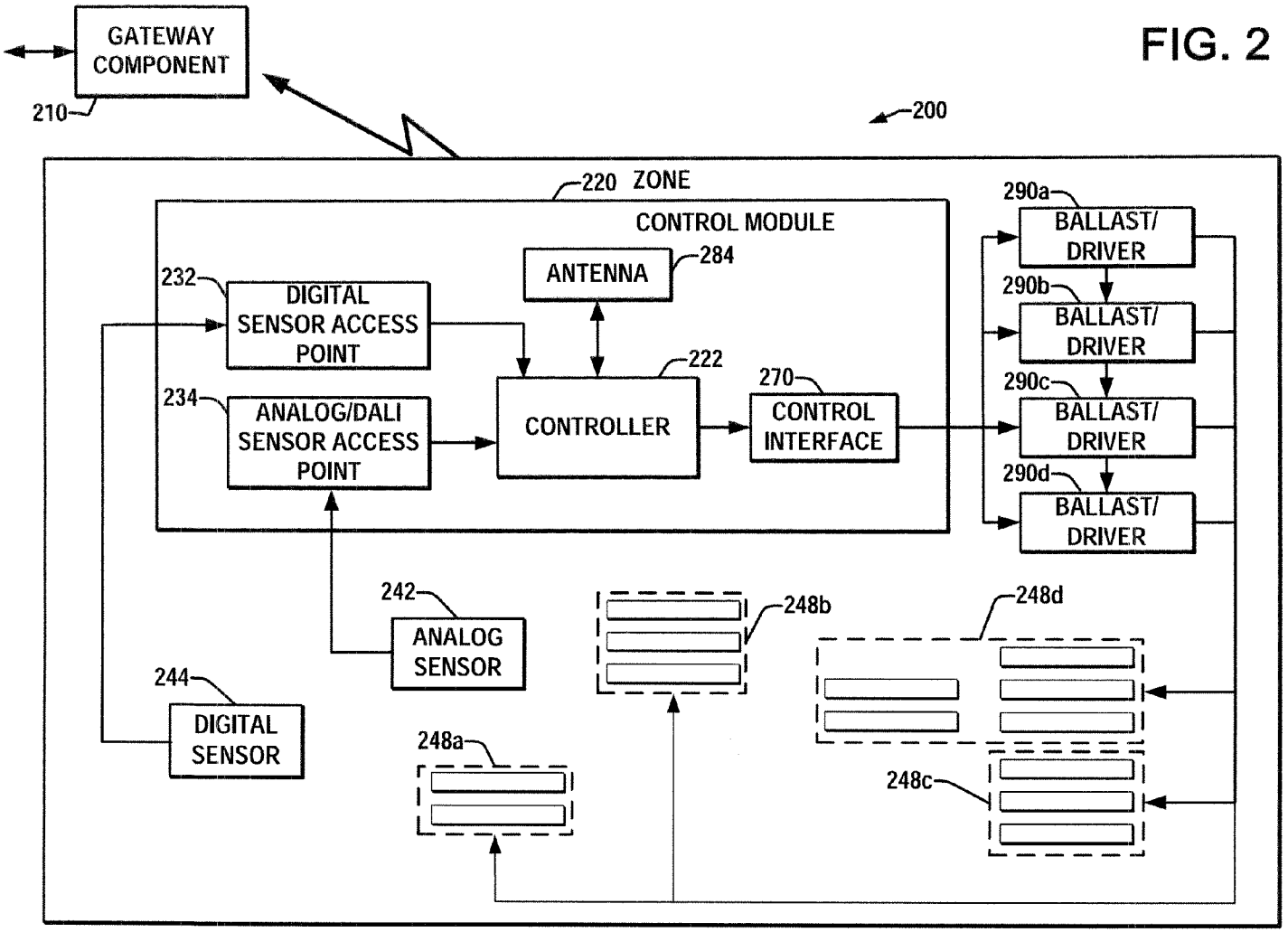
FIG. 2 illustrates a closed loop system, wherein the low power control module controls a plurality of ballast/drivers coupled to light sources via signals received from sensors within a zone, in accordance with an exemplary embodiment.

FIG. 2 illustrates a lighting control system for a zone 200, which includes a control module 220 to receive signals from an analog sensor 242 and a digital sensor 244 within the zone 200. The signal from the analog sensor 242 is received via an analog/DALI sensor access point. Similarly, the signal from the digital sensor 244 is received via a digital sensor access point 232 within the control module 220. The digital access point 232 and analog/DALI access point 234 can provide processing and scaling to the respective signals for consumption via a controller 222. The controller 222 can operate in substantially the same manner as the controller 122 discussed above. Once the controller 222 processing is complete, an output is sent to a control interface 270 that communicates with ballast/drivers 290*a*, 290*b*, 290*c* and 290*d*. The control interface 270 can communicate via the same standards and protocols as discussed above with regard to the control interface 170 within the system 100 utilizing analog, digital, PWM and/or DALI protocols.

The ballast/drivers 290*a*, 290*b*, 290*c* and 290*d* receive a control signal from the control interface 270. Based at least in part upon the signal received from the control interface 270, the ballast/drivers 290*a*, 290*b*, 290*c* and 290*d* output a signal to control light sources 248*a*, 248*b*, 248*c* and 248*d* respectively within the zone 200. In one embodiment, the control interface 270 directs one or more of the ballast/drivers 290*a-d* to dim one or more of the light sources 248*a-d*, wherein the ballast/drivers 290*a-d* output a voltage that is less than a previous value. In contrast, the control interface 270 can direct one or more of the ballast/drivers 290*a-d* to brighten the light output from one or more of the light sources 248*a-d*, wherein the subject ballast/drivers 290*a-d* output a voltage that is greater than a previous value.

The light output from the light sources 248*a-d* can be utilized to modify the output of the analog sensor 242 and/or the digital sensor 244. In one example, the analog sensor 242 measures the brightness within a space (e.g., emitted from one or more light sources 248*a-d*) and outputs a signal once a brightness level has been reached. Thus, the analog sensor 242 can output a signal to the analog/DALI sensor access point 234 causing the controller 222 to activate the control interface 270 to direct the ballast/driver 290 to increase the output of one or more of the light sources 248*a-d*. In this manner, the lighting control system 200 can operate as a closed loop system. Thus, once the light sources 248*a-d* have an increased light output as directed by the control module 220 in response to the original output of the analog sensor 242, such output can stop when the light level reaches a particular threshold within the zone 200.

Alternatively or in addition, the control module 220 can communicate with a gateway component 210 via an antenna 284. In operation, the controller 222 can output one or more signals to the antenna 284 subsequent to processing of received digital, analog and/or DALI signals. The antenna 284 can communicate this information wirelessly to the gateway component 210 to be relayed upstream to higher level control components within a lighting control system. It is contemplated that a plurality of control modules 220 can communicate with the gateway component 210 to provide a common control for each of a plurality of lighting zones within a predetermined space. The antenna 284 can communicate utilizing a ZigBee or equivalent wireless protocol, for example. The controller 222 can include a ZigBee prostack to facilitate such communication.

Figure 3:
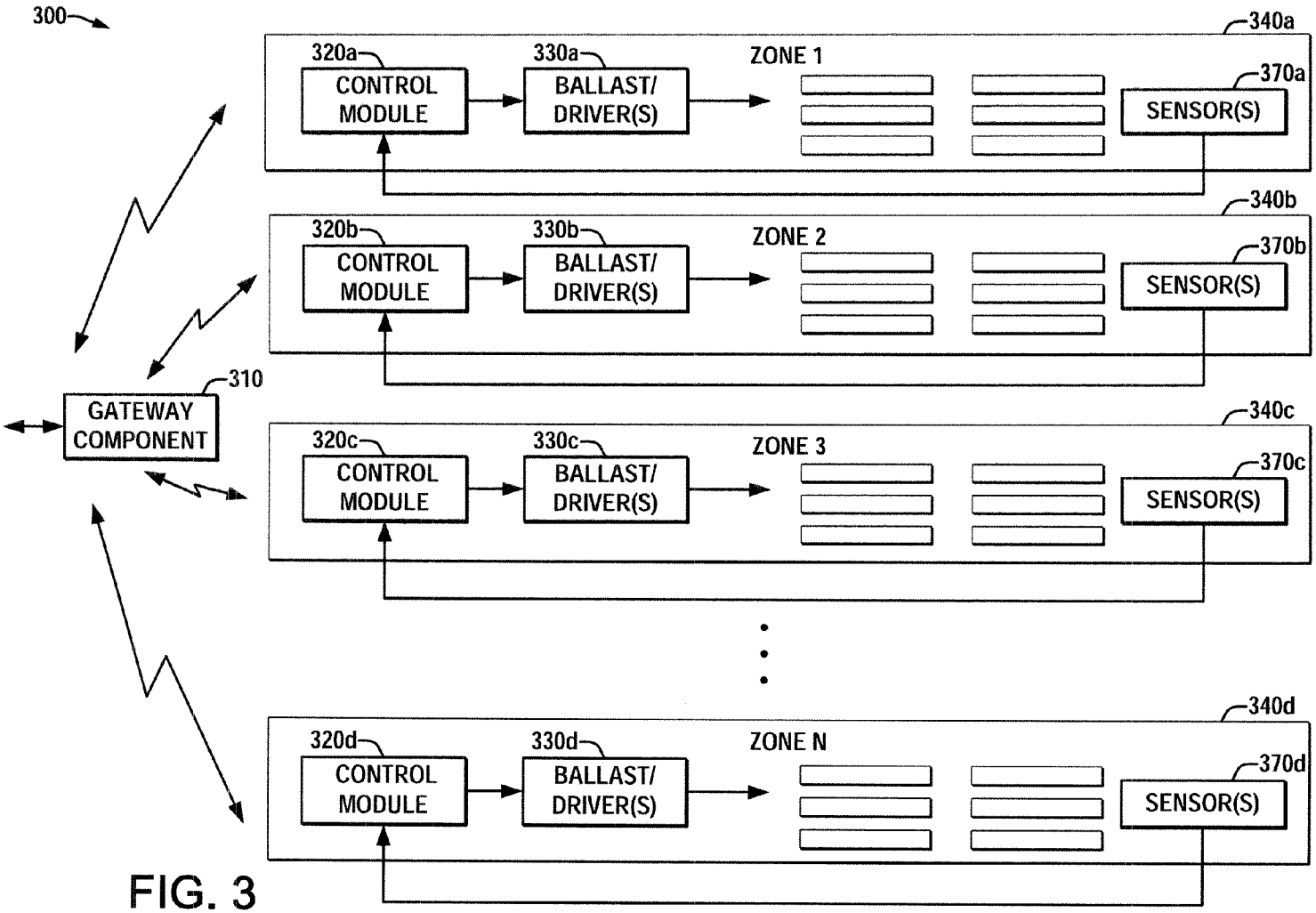
FIG. 3 illustrates a plurality of low power control modules each associated with a lighting zone, wherein each low power control module communicates with a common gateway component multiple ballast/drivers operating a plurality of light sources.

FIG. 3 illustrates a system 300 that includes low power control modules 320*a*, 320*b*, 320*c* and 320*d* that receive signals from respective sensors 370*a*, 370*b*, 370*c* and 370*d* within zones 340*a*, 340*b*, 340*c* and 340*d*. Each sensor can relate to one or more conditions in all or part of the respective zones 340*a-d*, such as occupancy, vacancy, light level, time, etc. Ballast/drivers 330*a*, 330*b*, 330*c* and 330*d* receive commands from the low power control modules 320*a-d* to modify light source output within each respective zone 340*a-d*. It is to be appreciated that the system 300 can include substantially any number of low power control modules to interface to one or more ballast/drivers. Further, each zone 340*a-d* can contain substantially any number of ballast/drivers and each ballast/driver can be coupled to substantially any number of light sources. Each zone 340*a-d* can contain a plurality of light sources located in an area proximate to each other such as one or more floors, a portion of a floor, a room, etc. Alternatively or in addition, zones 340*a-d* can be organized based on other parameters such as a common time period light sources are lit, common occupant (e.g., a business) within the zone and so on.

In one embodiment, a signal is received from one or more sensors 370*a-d* in a DALI compatible format. This signal can contain address information that relates to one or more zones 340*a-d* and/or one or more light sources within each zone 340*a-d*. The control module 320*a*, 320*b*, 320*c* and 340*d* can broadcast information (e.g., via a ZigBee protocol) to a gateway component 310, which can aggregate and further process the data received before sending it to one or more higher level control components. This data can be received by the gateway component 310 wirelessly and sent to the higher level control components via a hardwire connection in one approach.

The ZigBee specification can allow relatively seamless retrofitting of a communication system within an existing space such as an office, warehouse, etc. The ZigBee specification takes advantage of the generally low complexity and volume of information communicated within a building control architecture such as the system 300. Thus, a small stack size can be employed to communicate low data rates with a high throughput. In this manner, less power can be consumed to allow for a longer component battery life.

Figure 4:
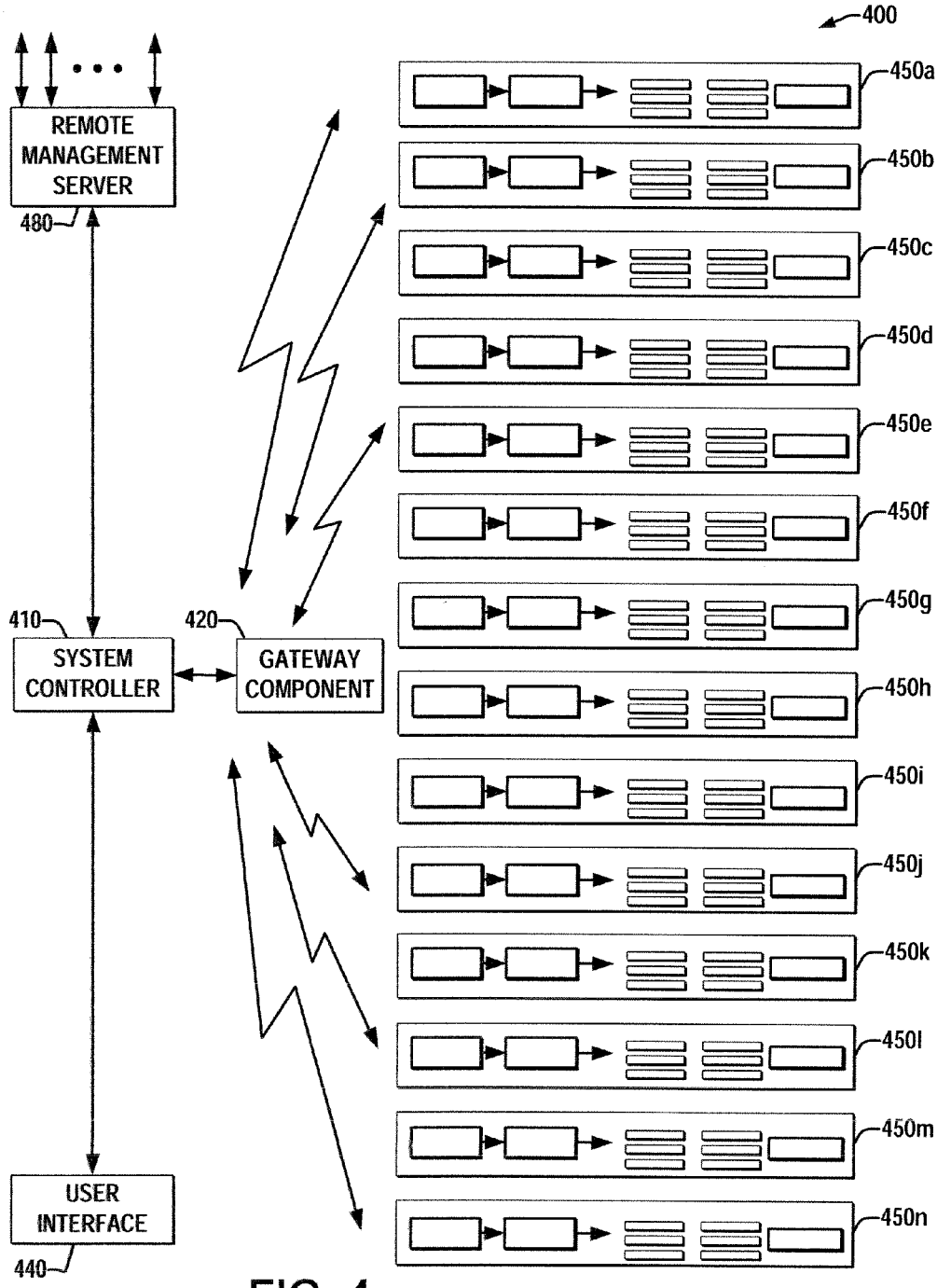
FIG. 4 illustrates a large scale control architecture wherein a system controller interfaces to a plurality of gateway components to facilitate lighting control over a plurality of zones.

FIG. 4 illustrates a lighting control system 400 that expands on the control hierarchy set forth within the system 300. In this embodiment, a layer of control is placed on top of zones 450*a-n*, wherein each zone is substantially similar to the zones 340 described above. A gateway component 420 receives wireless signals from each of the zones 450*a-n* and delivers them to a system controller 410. Each zone includes a low power control module, one or more ballast/drivers, light sources and sensors. Each zone 450*a-n* can modify light output of one or more light sources within based upon local control from each respective low power control module and/or the system controller via the gateway component 420. In one embodiment, the system 400 communicates via a mesh network topology.

A user interface 440 is coupled to the system controller 410 to display and to allow users to modify settings related to the lighting control system 400. The user interface 440 can display energy monitoring, alarms, reports, and graphs related to various control settings. In addition, a graphical representation of the physical lighting system can be presented to allow modifications related thereto. The user interface 440 allows system setup via lighting control and zone management. This setup can include multi-premise control, zone management with multiple scenario per zone flexibility, and configuration, management and control of nodes within the system 400. Sensors within the system 400 can be also be set up wherein devices are commissioned as they are brought online.

In one particular aspect, the user interface 440 receives metering information from the system controller 410 to allow energy monitoring. This metering data can be presented as it relates to each power meter within the system, wherein baseline loads for demand response programs are measured. Power usage, real time price and time of use rates can also be presented. A scorecard can be presented alongside the energy values to compare the metering data with predetermined metrics. In this manner, a user can quickly gauge whether any changes to the control system 400 are necessary to modify power usage. The user interface 440 can facilitate informed decision making to provide efficient use of power within the system 400. Information can be presented to the user in the form of reports, graphs, charts, etc. to present energy usage in both real time and historical contexts.

A user can set automated control to schedule power deliver to particular zones and/or light sources within each zone. If power usage within a portion and/or entire system 400 exceeds a predetermined level (e.g., Kwh power usage, hourly price rates, etc.), an alert can be triggered to notify appropriate personnel. In one example, the notification is sent via email to provide event conditions and actions that can be taken in response to the alert. In another example, a routine can be programmed via the user interface 440 to provide automated demand response to manage peak demand charges.

A remote management server 480 couples the system controller 410 to one or more disparate components such as other system controllers in other locales. In one embodiment, a company has systems similar to the system 400 in a plurality of geographic locations to allow centralized management. To this end, the remote management server 480 can provide remote access to a user interface (e.g., 440) to monitor and control the system 400. In this manner, a user can monitor and control the system 400 from substantially any location.

Figure 5:
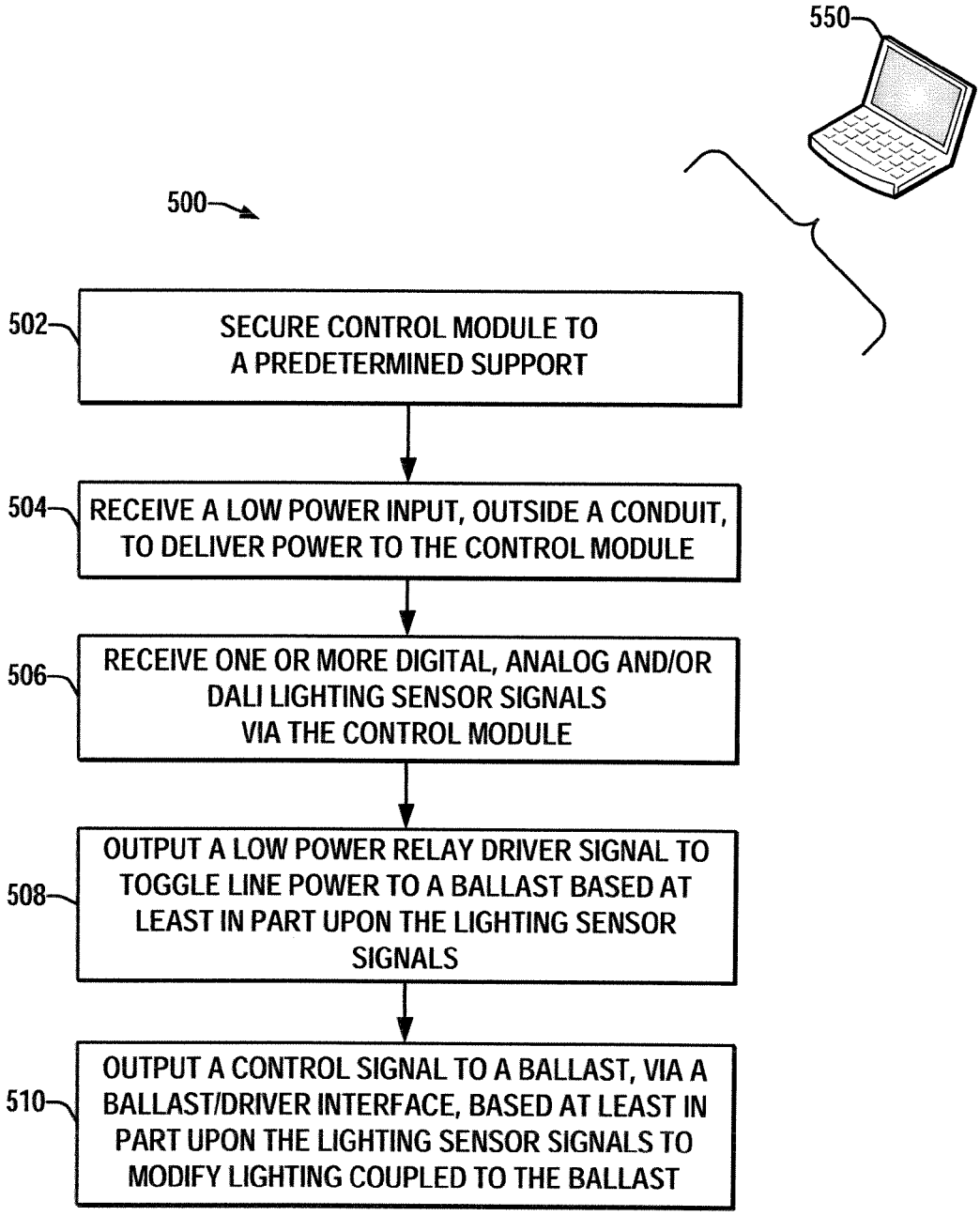
FIG. 5 illustrates a method to implement the low power control module into a lighting control system, in accordance with an exemplary embodiment.

FIG. 5 illustrates a methodology utilized to facilitate control of a lighting system via a control module. At reference numeral 502, a control module is secured to a predetermined support. In one aspect, the control module can be retrofit into a commercial space such as a building. The predetermined support, therefore, can be substantially any building structure located therein such as a ceiling tile, a support beam, a wall frame, etc. At 504, a low power input is received outside a conduit to deliver power to the control module. In this manner, the control module can be placed in substantially any location since the location is unreliant upon the location of high power input lines, which are generally contained within a conduit per typical building regulations. Such power can be around 24 VDC and delivered via a twisted pair, in one example.

At 506, one or more of a digital, an analog and/or a DALI lighting sensor signal is received via the control module. These sensor signals can be emitted from substantially any device within a lighting control system such as an occupancy sensor, a dimming module, a timer, etc. These devices are capable of communication via digital, analog and/or DALI protocols wherein the control module includes appropriate input components to receive and process such signals. Once these signals have been processed, at 508, a low power relay driver signal is output to toggle line power to a ballast/driver based at least in part upon the lighting sensor signals received. In one aspect, the relay driver signal is received via a relay wherein the relay is further coupled to a high powered line (e.g., at 277 VAC). When the relay is activated by the relay driver signal, power can be allowed to flow to the ballast/driver. Conversely, when the power relay driver signal deactivates the relay, power is cut off from delivery to the ballast/driver, thereby shutting off any light sources coupled thereto.

At 510, a control signal is output to a ballast/driver, via a control interface, based at least in part upon the lighting sensor signals to modify lighting coupled to the ballast/driver. The control signal can be one or more of a digital, an analog, a PWM and/or a DALI protocol. It is to be appreciated, that step 508 and 510 can be executed in a mutually exclusive fashion, wherein if power is cut off from the ballast/driver via the low power relay driver signal, step 510 is not executed. If, however, power is allowed to flow to the ballast/driver at 508, at 510 the control interface can modify lighting coupled to the ballast/driver by increasing or decreasing voltage delivered thereto to brighten or dim the light output from the light sources coupled thereto. In this manner, the methodology 500 allows a control module to modify light output within a lighting control system based at least in part upon lighting sensor signals received from within the system.

A computer 550 illustrates one possible hardware configuration to support the systems and methods described herein, including the method 400 above. It is to be appreciated that although a standalone architecture is illustrated, that any suitable computing environment can be employed in accordance with the present embodiments.

The computer 550 can include a processing unit (not shown), a system memory (not shown), and a system bus (not shown) that couples various system components including the system memory to the processing unit. The processing unit can be any of various commercially available processors. Dual microprocessors and other multi-processor architectures also can be used as the processing unit.

The system bus can be any of several types of bus structure including a memory bus or memory controller, a peripheral bus, and a local bus using any of a variety of commercially available bus architectures. The computer memory includes read only memory (ROM) and random access memory (RAM). A basic input/output system (BIOS), containing the basic routines that help to transfer information between elements within the computer, such as during start-up, is stored in ROM.

The computer 550 can further include a hard disk drive, a magnetic disk drive, e.g., to read from or write to a removable disk, and an optical disk drive, e.g., for reading a CD-ROM disk or to read from or write to other optical media. The computer 550 typically includes at least some form of computer readable media. Computer readable media can be any available media that can be accessed by the computer. By way of example, and not limitation, computer readable media may comprise computer storage media and communication media. Computer storage media includes volatile and non-volatile, removable and non-removable media implemented in any method or technology for storage of information such as computer readable instructions, data structures, program modules or other data Computer storage media includes, but is not limited to, RAM, ROM, EEPROM, flash memory or other memory technology, CD-ROM, digital versatile disks (DVD) or other magnetic storage devices, or any other medium which can be used to store the desired information and which can be accessed by the computer.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above can also be included within the scope of computer readable media.

A number of program modules may be stored in the drives and RAM, including an operating system, one or more application programs, other program modules, and program non-interrupt data The operating system in the computer 550 can be any of a number of commercially available operating systems.

A user may enter commands and information into the computer through a keyboard (not shown) and a pointing device (not shown), such as a mouse. Other input devices (not shown) may include a microphone, an IR remote control, a joystick, a game pad, a satellite dish, a scanner, or the like. These and other input devices are often connected to the processing unit through a serial port interface (not shown) that is coupled to the system bus, but may be connected by other interfaces, such as a parallel port, a game port, a universal serial bus ("USB"), an IR interface, etc.

A monitor, or other type of display device, is also connected to the system bus via an interface, such as a video adapter (not shown). In addition to the monitor, a computer typically includes other peripheral output devices (not shown), such as speakers, printers etc. The monitor can be employed with the computer 550 to present data that is electronically received from one or more disparate sources. For example, the monitor can be an LCD, plasma, CRT, etc. type that presents data electronically. Alternatively or in addition, the monitor can display received data in a hard copy format such as a printer, facsimile, plotter etc. The monitor can present data in any color and can receive data from the computer 550 via any wireless or hard wire protocol and/or standard.

The computer 550 can operate in a networked environment using logical and/or physical connections to one or more remote computers, such as a remote computer(s). The remote computer(s) can be a workstation, a server computer, a router, a personal computer, microprocessor based entertainment appliance, a peer device or other common network node, and typically includes many or all of the elements described relative to the computer. The logical connections depicted include a local area network (LAN) and a wide area network (WAN). Such networking environments are commonplace in offices, enterprise-wide computer networks, intranets and the Internet.

When used in a LAN networking environment, the computer is connected to the local network through a network interface or adapter. When used in a WAN networking environment, the computer typically includes a modem, or is connected to a communications server on the LAN, or has other means for establishing communications over the WAN, such as the Internet. In a networked environment, program modules depicted relative to the computer, or portions thereof, may be stored in the remote memory storage device. It will be appreciated that network connections described herein are exemplary and other means of establishing a communications link between the computers may be used.

It is to be appreciated that the foregoing examples are provided for illustrative purposes and that the subject innovation is not limited to the specific values or ranges of values presented therein. Rather, the subject innovation may employ or otherwise comprise any suitable values or ranges of values, as will be appreciated by those skilled in the art.

The invention has been described with reference to the preferred embodiments. Obviously, modifications and alterations will occur to others upon reading and understanding the preceding detailed description. It is intended that the invention be construed as including all such modifications and alterations.

The invention claimed is:

1. A lighting control system that is coupled to one or more ballast/drivers operating one or more light sources, comprising:

a low power control module that receives analog, digital and/or DALI signals from one or more sources, processes the signals to provide an appropriate lighting response and outputs one or more commands related to light output of the one or more ballast/drivers operating one or more light sources; and a gateway component that receives wireless signals from the low power control module to relay to one or more control components, the control components provide instruction to modify the light output of the one or more ballast/drivers operating one or more light sources based at least in part upon the one or more commands received from the low power control module and/or the gateway component;

wherein the low power control module comprises a controller operatively coupled with a control interface, an access point, and a wireless interface, and wherein the controller receives signals from one or more sources, correlates information within each signal to the one or more ballast/drivers within the system and outputs a command to modify power delivered to the one or more light sources.

2. The lighting control system according to claim 1, the low power control module further including:

a status indicator that provides a visual representation of a current status of the low power control module.

3. The lighting control system according to claim 2, wherein the status indicator displays at least three states, a first state that indicates the low power control module is working properly, a second state that indicates the communication to the low power control module is malfunctioning and a third state that indicates the low power control module is malfunctioning.

4. The lighting control system according to claim 1, further including:

an analog/DALI sensor access point that receives analog and/or DALI signals from the one or more sources, scales the analog and/or DALI signals and transmits the scaled analog and/or DALI signals to the controller.

5. The lighting control system according to claim 1, further including:

a digital sensor access point that receives digital signals from the one or more sources, scales the digital signals and transmits the scaled digital signals to the controller.

6. The lighting control system according to claim 1, further including:

a control interface that provides a signal to the ballast/driver to deliver appropriate power to one or more light sources coupled to the ballast/driver to provide an appropriate level of light output, based at least in part upon instruction from the controller.

7. The lighting control system according to claim 6, wherein the control interface provides an analog signal, a digital signal, a PWM signal and/or a DALI based signal that is related to a particular light level.

8. The lighting control system according to claim 1, further including:

a relay driver that receives signals from the controller to output a low power driver signal; and a relay that receives the low power driver signal and toggles a high power signal to the ballast/driver to turn the ballast/driver on or off.

9. The lighting control system according to claim 1, wherein the wireless signals are sent via a wireless protocol.

10. The lighting control system according to claim 1, wherein the low power control module is powered between 10-30VDC.

11. The lighting control system according to claim 1, wherein one or more ballast/drivers are coupled to a zone and each zone includes a plurality of ballast/drivers and light sources.

12. The lighting control system according to claim 11, wherein the one or more light sources are a gas-discharge lamp, a solid state lamp, an incandescent lamp and/or a halogen lamp.

13. A low power control module for controlling one or more light sources, comprising:

a power supply receiving an input voltage between 10-30VDC from an external power source and providing operating power for the low power control module;

at least one control interface operative to control a power output level of at least one connected ballast/driver;

at least one access point operative to receive at least one sensor signal or value from one or more external sensors, wherein the at least one sensor signal or value is at least one of an analog, a digital and/or a DALI sensor signal or value;

a wireless interface operative to wirelessly communicate with at least one external gateway component;

a controller including at least one processor powered by the power supply and operatively coupled with the control interface, the access point, and the wireless interface, the at least one processor operative to:

process the at least one sensor signal or value from the at least one access point, provide at least one connected lighting control command to the at least one control interface to control the power output level of the at least one connected ballast/driver based at least partially on the at least one sensor signal or value from the at least one access point, create at least one external lighting control command based at least partially on the at least one sensor signal or value from the at least one access point, and relay the at least one external lighting control command via the at least one external gateway component and the wireless interface to at least one external control component to modify a light output of at least one external ballast/driver not connected to the low power control module.

14. The low power control module of claim 13, further comprising at least one relay driver powered by the power supply and operatively coupled with the at least one processor, the at least one relay driver operative to control application of power to the at least one connected ballast/driver by controlling at least one external relay coupled with the at least one connected ballast/driver, wherein the at least one processor is operative to operate the at least one relay driver to control the at least one external relay based at least partially on the at least one sensor signal or value from the at least one access point.

15. The low power control module of claim 13, wherein the at least one processor is operative to:

receive at least one external command signal or value from the at least one external gateway component via the wireless interface, process the at least one external command signal or value, and provide the at least one connected lighting control command to the at least one control interface to control the power output level of the at least one connected ballast/driver based at least partially on the at least one external command signal or value from the at least one external gateway component.

16. The low power control module of claim 13, further comprising at least one status indicator that provides a visual representation of a current status of the low power control module, the status indicator operative to display at least three states including a first state that indicates the low power control module is working properly, a second state that indicates the communication to the low power control module is malfunctioning, and a third state that indicates the low power control module is malfunctioning.

17. The low power control module of claim 13, wherein the at least one access point (132, 134) comprises an analog/DALI sensor access point that receives analog and/or DALI signals from the one or more sources, scales the analog and/or DALI signals and transmits the scaled analog and/or DALI signals to the controller.

18. The low power control module of claim 13, wherein the at least one access point (132, 134) comprises a digital sensor access point that receives digital signals from the one or more sources, scales the digital signals and transmits the scaled digital signals to the controller.

19. The low power control module of claim 13, wherein the at least one control interface provides an analog signal, a digital signal, a PWM signal and/or a DALI to the at least one connected ballast/driver.

* * * * *